US005118210A

United States Patent [19]

Kobayashi et al.

[11] Patent Number: 5,118,210

[45] Date of Patent: Jun. 2, 1992

[54] PRINT HAMMERS OF PRINTING HEAD IN DOT LINE PRINTER

[75] Inventors: Hirotaka Kobayashi; Kenichi Kugai, both of Katsuta, Japan

[73] Assignee: Hitachi Koki Co., Ltd., Tokyo, Japan

[21] Appl. No.: 693,195

[22] Filed: Apr. 30, 1991

[30] Foreign Application Priority Data

May 18, 1990 [JP] Japan ..... 2-129872

[51] Int. Cl.[5] ..... B41J 9/12; B41J 2/25

[52] U.S. Cl. ..... 400/124; 400/121; 101/93.05

[58] Field of Search ..... 400/124, 124 WD, 121; 101/93.04, 93.05

[56] References Cited

U.S. PATENT DOCUMENTS 4,889,052 12/1989 Matsumoto et al. ..... 101/93.04

FOREIGN PATENT DOCUMENTS 0130354 6/1988 Japan ..... 400/124 WD

OTHER PUBLICATIONS

IBM Technical Disclosure Bulletin vol. 31, No. 1 Jun. 1988 "Pin Arrangement of Shuttle Printhead".

IBM Technical Disclosure Bulletin vol. 27, No. 2 Jul. 1984.

*Primary Examiner*—Edgar S. Burr
*Assistant Examiner*—Anthony Nguyen
*Attorney, Agent, or Firm*—Sughrue, Mion, Zinn, Macpeak & Seas

[57] ABSTRACT

Print hammers in a printing head of a dot line printer for printing with an ink ribbon multiple dot lines in a single shuttling direction and for providing a character line by the combination of the multiple dot lines in accordance with reciprocal motions of the print head while feeding a printing sheet in a line to line direction include hammer springs and printing pins provided at the free tip end portions of the springs. The printing pins are positioned offset from one another in the shuttling direction to thus perform multiple dot line printings in the single shuttling motion. Each of the printing pins has a printing pin surface in abutment with the printing sheet through the ink ribbon. The printing pin surface has a polygonal shape defined by a combination of ridge lines. All ridge lines extend obliquely with respect to the shuttling direction for facilitating grinding of the printing pins.

6 Claims, 3 Drawing Sheets

PRINT HAMMERS OF PRINTING HEAD IN DOT LINE PRINTER

BACKGROUND OF THE INVENTION

The present invention relates to a printing head of a dot line printer, and more particularly, to an improvement on tip ends construction of printing pins of print hammers in the printing head in which a plurality of printing pins are provided in a shuttling direction as well as in a line to line direction. Throughout the specification, the term "shuttling direction" indicates a transverse direction of a printing sheet or reciprocating or shuttling direction of the printing head so as to provide a dot printing line(s) in order to provide a character line, and the term "line to line direction" indicates feeding direction of the printing sheet.

In dot line printer, a printing head has a plurality of print hammers juxtaposedly arranged at a predetermined intervals in the shuttling direction. Upon reciprocating motion or shuttling motion of the printing head, the printing hammers are driven to obtain dot printings. More specifically, as shown in FIGS. 1 and 2, the printing head includes a plurality of printing hammers 10 provided side by side in the shuttling direction. Each of the printing hammers 10 includes a hammer springs 12, a printing pin 11 provided at free end of the hammer spring 12 and a plunger 13 provided on the hammer spring 12 but positioned more adjacent to a base end of the hammer spring 12 than the printing pin 11. The plungers 13 are selectively attracted by corresponding yokes (not shown), so that printing pins 11 are selectively moved toward the printing sheet to perform dot printing through an ink ribbon (not shown).

Shapes of the printing pins 11 and position alignment of the printing pins 11 are extremely important in order to provide a high quality print image. To this effect, the printing pins 11 undergo provisional machining or grinding so as to obtain a generally circular cross-section prior to their assembly to the corresponding hammer springs 12, and in the printing hammers shown in FIGS. 1 and 2, the printing pins 11 are arrayed in the shuttling direction, so that a single dot line is provided during one shuttling motion of the printing head. In this connection, accuracy of the attachment positions of the printing pins 11 relative to the hammer springs 12 is also very important.

For the assembly of the printing pin 11 to the hammer spring 12, as shown in FIG. 3, the provisionally machined printing pin 11 is inserted into a hole 12*a* of the hammer spring 12, and then the printing pin 11 is subjected to caulking to fixedly secure the pin 11 to the spring 12. Thus, accuracy of pin alignment is determinative by the positioning and caulking works of the printing pins 11. Alternatively, as shown in FIG. 4, the printing pin 11 provisionally subjected to machining or grinding is integrally connected to the hammer spring 12 by brazing. Thus, accuracy of the pin alignment is determinative by the brazing position or work.

According to the above described method for producing the printing hammers, the intended pin alignment may not be easily obtained due to several reasons. For example, if the position or the hole 12*a* or machining accuracy of the hole 12*a* is not appropriate, the pin alignment may be degraded. This degradation may also occur due to inaccuracy in caulking. For example, the pins 11 may not have the proper orientation with respect to the hammer spring 12. Further pin alignment is also degraded, due to inaccuracy in brazing. For example, it would be rather difficult to obtain a correct brazing position.

In order to improve the pin alignment, another method has been proposed through inhouse R & D activities in such a manner that the machining or grinding to the printing pins 11 is carried out after these are assembled, with the hammer springs 12. For example, as shown in FIGS. 5 and 6, the free end portions of the hammer springs are bent, and then, the bent end portions are subjected to machining or grinding so as to obtain rectangular printing pin face 11*a* in which two sides are directed in parallel with the shuttling direction indicated by an arrow X, and the remaining two sides are directed in the line to line direction indicated by an arrow Y as shown in FIGS. 7 and 8. By the subsequent grinding, operation the resultant printing pin has a truncated pyramid shape.

The grinding is performable since the grinding of the one printing pin does not affect the shaping of the other or neighboring printing pins because of the linear array of the printing pins in the shuttling direction. As a result, each two sides of the rectangular pin face 11*a* of the printing pins are directed in parallel with the shuttling direction (Of course, the remaining two sides of the rectangular face 11*a* are directed in the sheet feeding direction). However, this grinding is unavailable for a second type of printing hammers in which the printing pins on the printing hammers are positioned offset from one another in the sheet feeding direction as shown in FIG. 9. More specifically, in the second type of printing hammers, in an attempt to perform high speed dot line printing, the above offsetting arrangement can simultaneously provide multiple dot lines in one shuttling motion of the printing head (of course, several shuttling motions can provide a single character line by the combination of the multiple dot lines). Further, dot pitch is also reduced in the shuttling direction, so that high density in the printing pins results in this direction.

SUMMARY OF THE INVENTION

With the arrangement, it is possible to perform grinding to the printing pin in a direction parallel with the line to line direction without affecting the shape of the neighboring printing pins, since two grinding wheels G, G do not interfere with the other or neighboring printing pins. (As shown in the grinding work with respect to a printing pin 11A in FIG. 9). On the other hand, for grinding the other two sides of the printing pin 11, assuming that the grinding is effected to the printing pin 11C in a direction parallel with the shuttling direction to obtain the rectangular face 11*a* (see FIG. 7), one of the grinding wheel G1 excessively grinds the neighboring printing pin 11D, and the other grinding wheel G2 excessively grinds the other neighboring printing pin 11B. Thus, it becomes impossible to obtain the desired configuration with respect to the pins 11B and 11D.

In order to avoid this drawback, the reduction in diameter of the grinding wheel G has been contemplated. However, the dot density is relatively high in case of the offsetting arrangement of the printing pins as described above. For example, assuming that the dot density is 160 dpi (dot/inch) in the shuttling direction, one dot printing is made at every shuttling of the hammer bank by 1/160 inches. In this case, the printing pins provide an extremely small pitch of about 0.1 inches in the shuttling direction. Further, assuming that the dot density is 168 dpi in the line to line direction, the printing pins provide density of about 0.15 mm in the line to line direction. It should be noted that the density of the printing pins in the shuttling direction is not related to the intended dot printing density. However, the density of the printing pins in the line to line direction is determined by the dot printing density. For example, if the dot printing density of 168 dpi is intended in the line to line direction, the pitch (P) of the printing pins in this direction becomes 0.15 mm (reciprocal of the dot printing density, i.e., P=25.4/168; 1 inch=25.4 mm).

In this case, as shown in FIG. 10, at most, a diameter of the grinding wheel is 10 mm (maximum available diameter) so as to prevent the grinding surface of the grinding wheel from abutment with the neighboring printing pin. However, it would be almost impossible to perform grinding work to the workpiece by using such a small grinding wheel. Accordingly, in case of the print hammers shown in FIG. 9, it would be impossible to perform subsequent machining or grinding to the printing pins after they are assembled to the hammer springs 12. In other words, the first described a method must be carried out, which in turn degrades the pin alignment as described above.

It is therefore, an object of the present invention to overcome the above described drawbacks and disadvantages, and to provide an improved printing head.

Another object of the invention is to provide such a printing head in which subsequent machining to the printing pins is performable after these become integral with the hammer springs to thereby enhance geometrical pin positions even in the case of the print hammers where a plurality of printing pins are positioned offset from one another with respect to the line to line direction and the printing pins are highly densely provided for achieving the multiple dot line printing.

These and other objects of the present invention will be attained by providing print hammers in a printing head of a dot line printer for printing with an ink ribbon multiple dot lines in a single shuttling direction and for providing a character line by the combination of the multiple dot lines in accordance with a reciprocal motion of the print head while feeding a printing sheet in a line to line direction, the print hammers comprising: (a) a plurality of hammer springs extending side by side in the shuttling direction, each of the hammer springs having free ends, and (b) an equal plurality of printing pins positioned at the free ends of the hammer springs and positioned offset from one another in the line to line direction for simultaneous multiple dot line printing in the single shuttling motion, each of the printing pins having a printing pin face abutting the printing sheet through the ink ribbon, the printing pin face being defined by ridge lines extending obliquely with respect to the shuttling direction for facilitating grinding, by the printing pins.

BRIEF DESCRIPTION OF THE DRAWINGS

In the drawings;

FIG. 16 illustrates front and side views of a hexagonally-shaped printing pin face and a method of grinding the hexagonally-shaped printing pin face; and FIG. 17 illustrates front and side views of an octagonally-shaped printing pin face and a method of grinding the octagonally-shaped printing pin face.

DETAILED DESCRIPTION OF THE PREFERRED EMBODIMENTS

Figure 1:
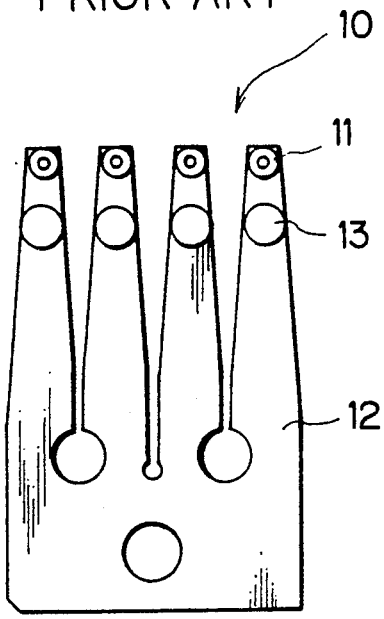
FIG. 1 PRIOR ART
FIG. 1 is front view showing a printing hammers according to one conventional print head.
Figure 2:
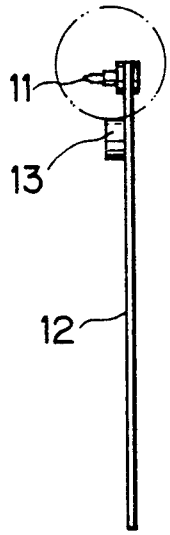
FIG. 2 PRIOR ART
FIG. 2 is a side view showing the conventional print hammers.
Figure 3:
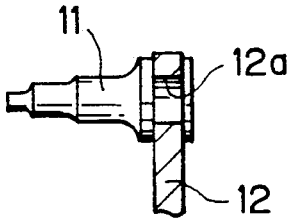
FIG. 3 PRIOR ART
FIG. 3 is an enlarged cross-sectional side view particularly showing one example of an attachment of a printing pin to a hammer spring according to the conventional print hammers.
Figure 4:
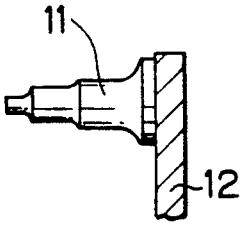
FIG. 4 PRIOR ART
FIG. 4 is an enlarged cross-sectional side view particularly showing another example of an attachment of a printing pin to a hammer spring according to the conventional printing hammers.
Figure 5:
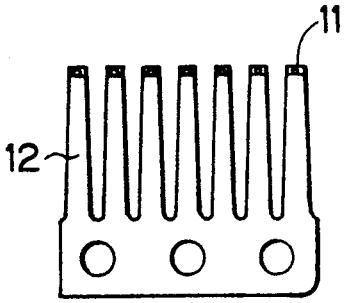
FIG. 5 PRIOR ART
FIG. 5 is front view showing a print hammers according to a second conventional print head.
Figure 6:
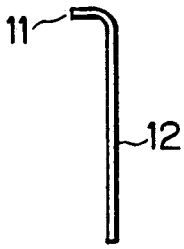
FIG. 6 PRIOR ART
FIG. 6 is a side view showing the second conventional print hammers.
Figure 7:
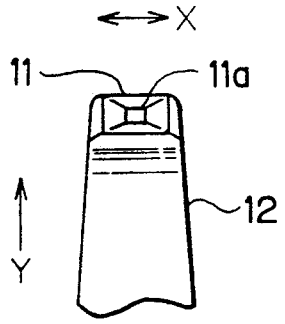
FIG. 7 is an enlarged front view showing the printing pin proposed through inhouse R & D activities.
Figure 8:
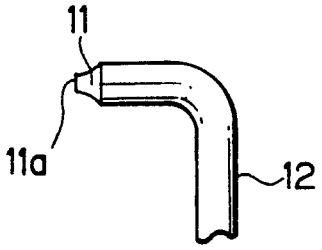
FIG. 8 is an enlarged side view showing the printing pin shown in FIG. 7.
Figure 9:
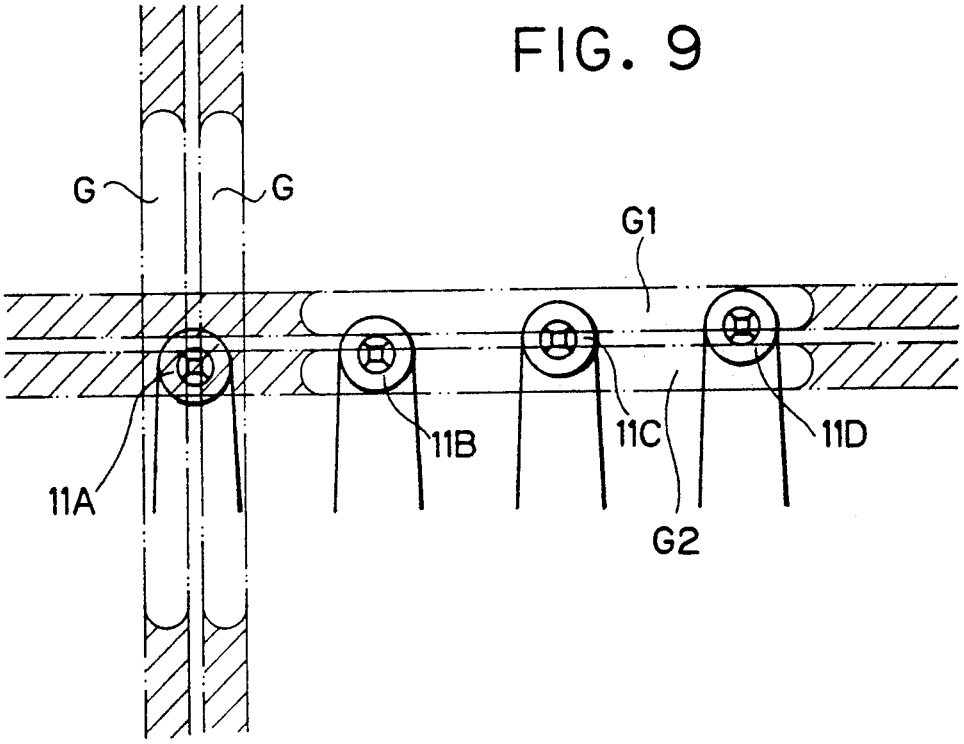
FIG. 9 is an enlarged front view showing a conventional multiple array of printing pins to which machining or grinding is effected in accordance with the inhouse proposal in the R & D activities.
Figure 10:
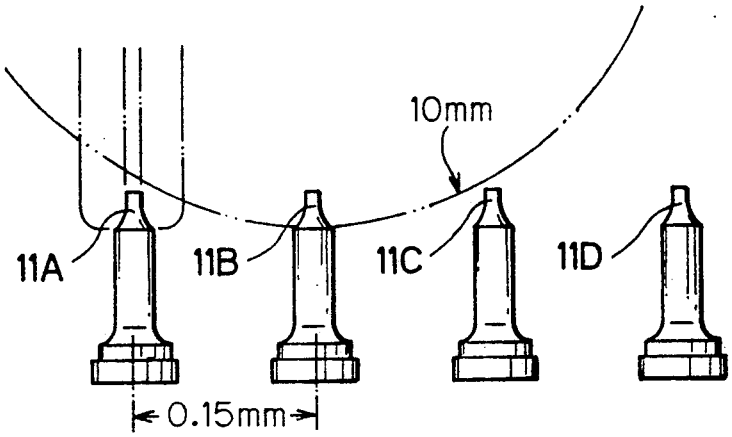
FIG. 10 is a plan view showing the print pin portions to which grinding is effected with using a grinding wheel in accordance with inhouse R & D activities.
Figure 11:
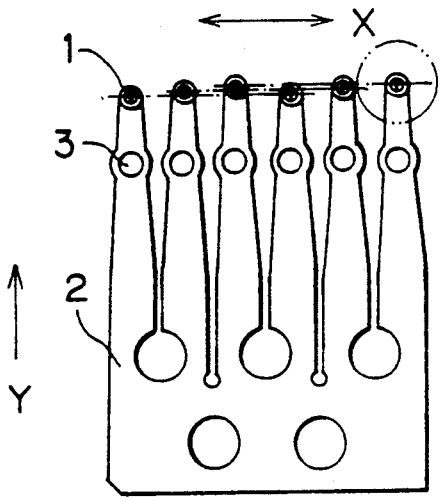
FIG. 11 is a front view showing print hammer arrays of a print head according to one embodiment of the present invention.
Figure 12:
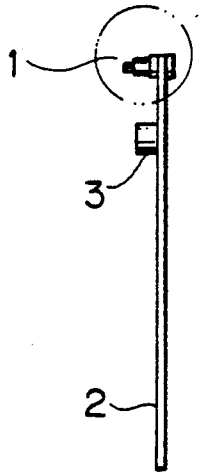
FIG. 12 is a side view of the print hammer according to the embodiment of this invention shown in FIG 11.

A print hammer of a print head according to one embodiment is this invention will be descried with reference to FIGS. 11 through 15. As shown in FIGS. 11 and 12, the print hammers are of a type in which a plurality of printing pins 1 are positioned offset from one another with respect to a line to line direction so as to perform multi dot line printing in a single shuttling motion of the printing head. In the illustrated embodiment, six hammer springs 2 are provided side by side in the shuttling direction indicated by an arrow X, and base end portions of the hammer springs 2 are joined with one another. An equal plurality of printing pins 1 are provided at free ends of the hammer springs 2. These pins 1 are positioned offset from one another in the line to line direction or sheet feeding direction indicated by an arrow Y. Further, plungers 3 formed of a magnetic material are provided at intermediate portions of the hammer springs 2. These staggered arrangement is the same as that shown in FIG. 9.

Figure 13:
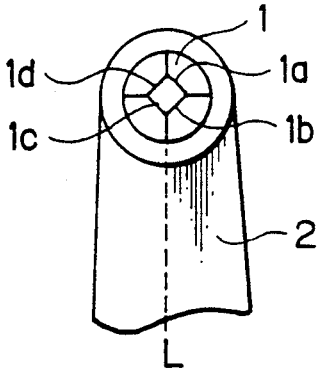
FIG. 13 is an enlarged front view particularly showing printing pin of the print hammer according to the embodiment of this invention shown in FIG. 11.
Figure 14:
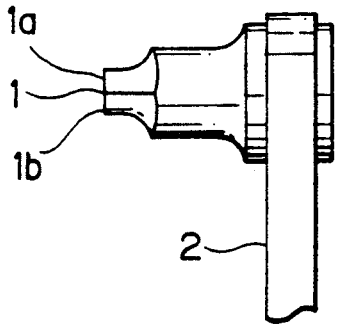
FIG. 14 is an enlarged side view of the printing pin according to the embodiment of this invention shown in FIG. 11.

Each of the printing pins 1 has a tip end portion shown in FIGS. 13 and 14. That is, the printing pin face has four sides orienting obliquely with respect to the shuttling direction X. In other words, four ridge lines 1*a*, 1*b*, 1*c* and 1*d* which define the rectangular printing pin face do not extend in parallel with the shuttling direction. Further, one group of neighboring ridge lines 1*a* and 1*b* extend symmetrically with another group of neighboring ridge lines 1*c* and 1*d* with respect to a center line L of the printing pin which center line L extends in the line to line direction Y.

Figure 15:
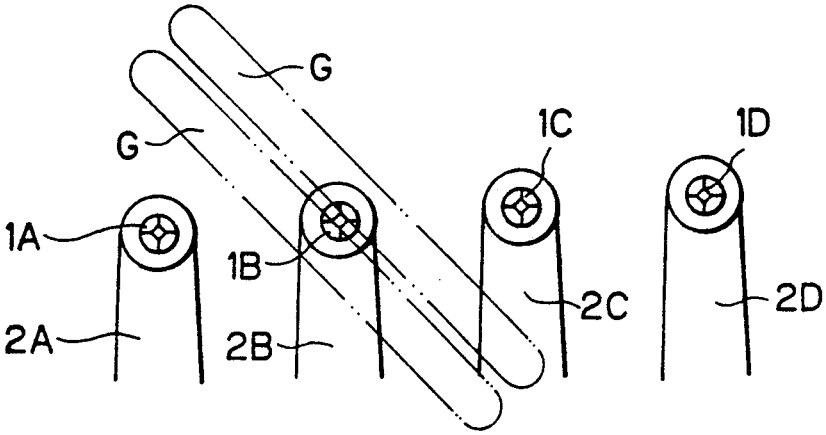
FIG. 15 is an enlarged front view showing the printing pin portions and grinding manner according to the embodiment of this invention.

With this intended structure in mind, as best shown in FIG. 15, one printing pin 1B associated with the hammer spring 2B can undergo grinding with one orientation of grinding wheels G and G upon rotation thereof about their mutual axes without abutting to the neighboring printing pins 1A and 1C of the neighboring hammer springs 2A and 2C. Therefore, the shape or configuration of the neighboring printing pins 1A and 1C is not degraded. The same is true with respect to the remaining printing pins and with respect to the second grinding direction. Thus, the resultant printing pin has a shape of a frustum of a pyramid or a truncated pyramid.

Consequently, subsequent grinding work can be carried out after the printing pins become integral with the hammer springs, and accordingly, intended geometry and shapes of the printing pins can be obtained, while maintaining desired pin alignment in spite of the offsetting arrangement of the printing pins. As a result, high printing quality is attainable even in the case of high speed printing.

While the invention has been described in detail and with reference to a specific embodiment thereof, it would be apparent to those skilled in the art that various changes and modifications may be made therein without departing from the spirit and scope of the invention. For example, in the illustrated embodiment, the combination of the ridge lines constitutes the rectangular printing pin face. However, other polygonal printing pin face such as hexagonal and octagonal shape is also available as long as the ridge lines do not extend in parallel with the shuttling direction. Further, the concept in the ridge line orientation with respect to the shuttling direction in the present invention is also available in case of the print hammers in which printing pins are arrayed with an in-line fashion in the shuttling direction.

What is claimed is:

1. A plurality of print hammers in a printing head of a dot line printer for printing with an ink ribbon multiple dot lines in a single shuttling direction and for providing a character line by the combination of the multiple dot lines in accordance with reciprocal motions of said printing head while feeding a printing sheet in a line to line direction, the print hammers comprising:

a plurality of hammer springs extending side by side in the shuttling direction, each of the hammer springs having free ends; and a plurality of printing pins corresponding in number to said plurality of hammer springs and positioned at the free ends of the hammer springs and positioned offset from one another in the line to line direction for simultaneously multiple dot line printing in the single shuttling direction, each of the printing pins having a printing pin face abutting the printing sheet through the ink ribbon, the printing pin face being defined by a plurality of ridge lines each one of which extends obliquely with respect to the single shuttling direction for facilitating grinding of the printing pins such that only a selected printing pin is ground during a grinding operation, each of said ridge lines of said printing pin face of each of said printing pins is joined to two others of said ridge lines to define groups of neighboring ridge lines, wherein a first group of neighboring ridge lines extends symmetrically with a second group of neighboring ridge lines with respect to a center line of the printing pin face, and wherein said center line extends in the line to line direction and a combination of the ridge lines which define the printing pin face has a polygonal shape.

2. The print hammers as claimed in claim 1, wherein a combination of the ridge lines defining the printing pin face has a hexagonal shape.

3. The print hammers as claimed in claim 1, wherein a combination of the ridge lines defining the printing pin face has an octagonal shape.

4. The print hammers as claimed in claim 1, wherein the printing pins provide a first patch of 0.1 inches in the single shuttling direction and a second pitch of 0.15 mm in the line to line direction.

5. The plurality of print hammers as claimed in claim 1, wherein the printing pin has a shape of a frustum of a pyramid, and a truncated portion thereof serves as the printing pin face.

6. A plurality of print hammers in a printing head of a dot line printer for printing with an ink ribbon multiple dot lines in a single shuttling direction and for providing a character line by the combination of the multiple dot lines in accordance with reciprocal motions of said printing head while feeding a printing sheet in a line to line directions, the print hammers comprising:

a plurality of hammer springs extending side by side in the shuttling direction, each of the hammer springs having free ends; and a plurality of printing pins corresponding in number to said plurality of hammer springs and positioned at the free ends of the hammer springs and positioned offset from one another in the line to line direction for simultaneous multiple dot line printing in the single shuttling direction, each of the printing pins having a printing pin face abutting the printing sheet through the ink ribbon, the printing pin face being defined by a plurality of ridge lines extending obliquely with respect to the single shuttling direction for facilitating grinding of the printing pins, wherein each of said ridge lines of said printing pin face of each of said printing pins is joined to two others of said ridge lines to define groups of neighboring ridge lines, wherein a first group of neighboring ridge lines extends symmetrically with a second group of neighboring ridge lines with respect to a center line of the printing pin face, wherein said center line extends in the line to line direction, and wherein the printing pin has a shape of a frustum of a pyramid, and a truncated portion thereof serves as the printing pin face having a rectangular shape.

* * * * *